US008967048B2

(12) United States Patent
Harding et al.

(10) Patent No.: US 8,967,048 B2
(45) Date of Patent: Mar. 3, 2015

(54) TIMING MODULE

(75) Inventors: David Bruce Harding, Johannesburg (ZA); Albertus Abraham Labuschagne, Brakpan (ZA); Andre Louis Koekemoer, Boksburg (ZA); Christopher Malcolm Birkin, Centurion (ZA); Craig Charles Schlenter, Johannesburg (ZA)

(73) Assignee: Detnet South Africa (Pty) Ltd. (ZA)

( * ) Notice: Subject to any disclaimer, the term of this patent is extended or adjusted under 35 U.S.C. 154(b) by 802 days.

(21) Appl. No.: 13/179,652

(22) Filed: Jul. 11, 2011

(65) Prior Publication Data

US 2012/0012019 A1 Jan. 19, 2012

(30) Foreign Application Priority Data

Jul. 12, 2010 (ZA) ..... 2010/04911

(51) Int. Cl.

| | |
|---|---|
| ***F42D 1/05*** | (2006.01) |
| ***F42D 1/04*** | (2006.01) |
| ***F42B 3/12*** | (2006.01) |
| ***F42C 11/06*** | (2006.01) |
| ***G04F 10/00*** | (2006.01) |

(52) U.S. Cl.

CPC ..... *F42D 1/043* (2013.01); *F42B 3/121* (2013.01); *F42C 11/06* (2013.01); *G04F 10/00* (2013.01)

USPC ..... 102/206

(58) Field of Classification Search

CPC ..... F42D 1/05; F42D 1/045; F42D 5/00

USPC ..... 102/206, 215

See application file for complete search history.

(56) References Cited

U.S. PATENT DOCUMENTS

| | | | | |
|---|---|---|---|---|
| 4,632,032 | A * | 12/1986 | Muller | 102/206 |
| 5,101,727 | A | 4/1992 | Yarrington | |
| 5,133,257 | A | 7/1992 | Jonsson | |
| 5,173,569 | A | 12/1992 | Pallanck et al. | |
| 5,435,248 | A | 7/1995 | Rode et al. | |
| 5,929,368 | A | 7/1999 | Ewick et al. | |
| 5,942,718 | A | 8/1999 | Falquete et al. | |
| 7,624,681 | B2 | 12/2009 | Goodman et al. | |
| 8,857,339 | B2 * | 10/2014 | Muller et al. | 102/206 |
| 2006/0249045 | A1 | 11/2006 | Goodman et al. | |
| 2008/0098921 | A1 * | 5/2008 | Labuschagne et al. | 102/202.5 |
| 2011/0155012 | A1 | 6/2011 | Perez Cordova et al. | |
| 2013/0180422 | A1 * | 7/2013 | Liebenberg | 102/206 |

FOREIGN PATENT DOCUMENTS

| | | |
|---|---|---|
| CL | 499-2010 | 8/2010 |
| DE | 4427296 A1 | 2/1996 |
| WO | 94/15169 A1 | 7/1994 |

OTHER PUBLICATIONS

English Abstract of German Patent Publication No. 44 27 296 A1, published Feb. 8, 1996.

English specification of South African Patent Application No. 95/6449, filed Aug. 2, 1995, published May 29, 1996, corresponding to German Patent Publication No. 44 27 296 A1.

* cited by examiner

*Primary Examiner* — Reginald Tillman, Jr.

(74) *Attorney, Agent, or Firm* — Cantor Colburn LLP

(57) ABSTRACT

A timing module for use in a detonating system which includes discriminating and validating arrangements which sense and validate at least one characteristic of at least one parameter produced by at least one shock tube event and an electronic timer which executes a timing interval in response thereto.

38 Claims, 2 Drawing Sheets

TIMING MODULE

CROSS-REFERENCE TO RELATED APPLICATION

This application claims priority to South African Provisional Patent Application No. 2010/04911, filed Jul. 12, 2010, incorporated by reference herein in its entirety.

BACKGROUND OF THE INVENTION

1. Field of the Invention

This invention relates to a timing module for use in a blasting system.

2. Related Art

Electronic detonators in a blasting system are typically interconnected through the use of elongate electrical conductors. The cost of the conductors, which are normally of copper, can be high and constitutes a significant part of the overall cost of the system.

Alternative approaches have been used to establish blasting systems. For example, detonators can be interconnected by using fibre optic cables. It is also possible to fire detonators, which are not physically interconnected, by using radio frequency signals. These techniques have, however, not been adopted on a large scale.

An electronic timing module is advantageous in that it can be programmed with a time delay which is executed in a highly reliable manner with a small error. Also, the time delay can extend over a lengthy period, several seconds in duration. Compared to this, a time delay which is generated using a pyrotechnical element is generally accurate only for a relatively short delay period. The accuracy is dependent on chemical and physical events and, inherently, it is usually not possible to generate a time delay period of several seconds duration with the same degree of accuracy as with an electronic timing module. On the other hand a pyrotechnic delay element is well-suited for use with a signal transmission device such as a shock tube which propagates a firing signal by means of a combustion, deflagration, detonation or similar event without using metallic conductors.

U.S. Pat. No. 5,133,257 describes an apparatus which includes a non-electrical ignition device and an electrical igniter which is responsive to the device. Use is made of a transducer for producing an electrical signal in response to a non-electrical energy input.

In U.S. Pat. No. 5,173,569, energy from a force produced by a non-electric, signal communication system (a shock tube), is converted to an electrical output signal and a time delay is then electrically generated. Similarly, WO 94/15169 describes a detonator assembly wherein energy from a non-electric impulse signal activates an electric delay circuit.

Chilean patent application No. 499-2010 describes a high precision delay system for the firing of a detonator wherein activation of a shock tube is detected by means of sensors such as electromechanical (impact), photoelectric, electroacoustic and piezoelectric sensors. In response thereto a detonator is fired.

The aforementioned techniques can substantially eliminate or reduce the use of interconnecting metallic conductors. However, some implementations are relatively expensive. Also, due care must be taken to prevent a detonator firing element from reacting to a detected characteristic which does not originate from a relevant shock tube.

For example, in the Chilean specification reference is made to repetitive sensing to verify "complete activation of the shock tube". This is effected by detecting a light signal at two spaced locations on the shock tube. It is however not understood whether a procedure for verifying the source of the light signal is implemented, in order to avoid inadvertent firing of the detonator due to detection of an extraneous light source. In this respect it is pointed out, firstly, that light from an external source, which could be a light impulse or light from a constant light source, (not emanating from the shock tube in question) could be detected during one time window or during multiple time windows and such detection or detections could be treated as having come from the shock tube. Also, as a shock tube often includes an elongate tubular structure made from a light-transmissive plastics material, it is possible that light from a first shock tube could be emitted in a radial direction from the first tube, and impinge on a second, adjacent tube. Detection of light in the second tube could thus be linked, erroneously, to a shock tube event in the second shock tube and this could result in incorrect operation of a detonator system.

An object of the present invention is to provide a timing module which is responsive to predetermined input criteria, subject to validation thereof, in a reliable manner and which, at least in one embodiment when incorporated into a blasting system, allows for the substantial elimination of electrical conductors. The invention is described hereinafter with particular reference to a time delay which is directly associated with a detonator. This however is illustrative only. Various inventive principles described herein can be used in different ways. The timing module could for example be used at any location in a blasting system at which a time delay is required. The module can be used to generate a time delay on a surface between adjacent detonators which are connected to a harness in a blasting system.

SUMMARY OF THE INVENTION

The invention provides a timing module for use in a blasting system which includes a discriminating arrangement with at least one sensor which senses at least one characteristic of at least one parameter generated by at least one shock tube event, a validation arrangement which produces at least a first output signal if the at least one sensed characteristic is validated, and a timer which completes execution of a timing interval of a predetermined duration only if, at least, the first output signal is produced.

The execution of the timing interval may be commenced upon the occurrence of at least one designated factor, e.g., the sensing of the at least one characteristic or the validation thereof, the sensing of a plurality of characteristics or the validation thereof, or any suitable equivalent factor.

Thus, detection (sensing) of a characteristic of a shock tube event parameter cannot, in itself, result in execution of the timing interval. At least the sensed characteristic must be validated for execution of the timing interval to take place. Validation can take place in different ways depending, at least, on the nature of the characteristic.

As used herein "shock tube event" means a combustion, deflagration, detonation, signal propagation or similar process in a shock tube.

The parameter may be any discernable or detectable output which is produced by the shock tube event. The parameter, for example, may be selected from an electromagnetic signal including light, an acoustic signal, a pressure wave, a force, heat emission and temperature.

The characteristic may be a frequency, amplitude, rate of change or other suitable attribute of the parameter.

The discriminating arrangement may include a plurality of sensors and each sensor may be responsive to at least one characteristic of a respective parameter. Each sensor may directly produce a respective output signal. Alternatively an output signal may be produced in any suitable way (e.g., by means of an electrical circuit, software or firmware) in response to a signal from the sensor.

It is possible for a sensor to be responsive to two or more characteristics. For example, a sensor may be responsive to a temperature level and to the rate of change of temperature. Similarly, a sensor may be responsive to the amplitude, frequency or rate of change of an electromagnetic signal such as light, or to the amplitude, rate of change or duration of a pressure wave, an acoustic signal or a force. Use may be made of two or more sensors which are responsive to different characteristics, or which are responsive to some of the same, or all of the same, characteristics. This approach holds particular benefits from a safety viewpoint. For example, by detecting at least two characteristics from one or more parameters and then subjecting each detected characteristic to a validation process, a high degree of reliability and authenticity is achieved. These aspects are of paramount importance in a detonator system. Thus, according to a preferred aspect of the invention, at least two independent parameters which coexist in a shock tube event are sensed and validated.

In U.S. Pat. No. 5,133,257, energy from a pressure or shock wave is applied to a piezoelectric transducer to generate an electric pulse which charges a capacitor. The energy in the capacitor is subsequently used to fire an igniter in a detonator. In the present invention, if the parameter is, for example, a pressure wave, use is not made of the energy in the wave to fire an igniter. Instead one or more characteristics of the pressure wave are validated and, in response to a successful validation, operation of a timer is controlled. Also, if the timing module is directly associated with a detonator, the energy for ignition is derived from a battery or other energy source which is associated with the detonator or the timing module.

The invention is not limited in respect of the characteristics of the parameters, nor in respect of the parameters, which are sensed and validated.

A parameter may be inherently present in the shock tube and may be such that is produced in a repetitive and predictable manner from a controlled process of manufacturing the shock tube. Alternatively, or additionally, one or more substances may be used in the manufacturing process so that, upon ignition of the shock tube, at least one predetermined event of defined characteristics is produced. These characteristics may, conveniently, be frequency-dependent. For example, substances may be added to the shock tube which are ignited when the shock tube is ignited and which thereupon emit radiation at respective defined frequencies which are uniquely associated with the substances and hence with the shock tube. This feature enables the use of the timing module, or of the shock tube, to be tightly controlled, e.g., for security or safety reasons for, if a particular characteristic or characteristics are not detected, the timer is maintained inoperative and, subject to circuit considerations, etc., an associated detonator can then not be fired.

It is possible for a sensor to be responsive to characteristics of one or more parameters on a basis integrated with respect to time, differentiated with respect to time (i.e., rate of change) or on any other appropriate basis. It is noted, for example, that although detection of an amplitude or magnitude of a parameter such as light, at each of two locations spaced apart on a shock tube, is indicative of ignition of the shock tube it is possible, nonetheless, for the detectors to respond to extraneous light sources. This, in turn, could result in a malfunction. It is therefore desirable for the full execution of a timing interval to be dependent, not on an absolute value or magnitude of a parameter (although this measurement could be used in conjunction with other measurements) but on one or more characteristics which are less likely to be generated by an extraneous source. For example, a temperature value in excess of a predetermined minimum may be indicative of a shock tube event. However, the rate of change of temperature, of a defined value or within a defined range, might be associated more accurately and reliably with a genuine shock tube event. Similarly, a characteristic which is integrated with respect to time may be associated in a more secure manner with a shock tube event. Thus the integral, with respect to time, of the amplitude of a light or other electromagnetic signal, at a designated frequency, or over a defined frequency band, is indicative of the energy at that frequency or in that band, and the integrated value may be used as a verification factor.

To enhance the safety and reliability of operation of the timing module it is preferred that one or more output signals are generated in response to one or more characteristics of at least two parameters. Output signals from, or output signals initiated by, one or more sensors, are preferably processed in series and, optionally, are connected via one or more AND gates or similar logic devices to ensure that the timer executes a timing interval of a predetermined duration only if the parameters are present in a defined time or amplitude or other relationship to one another. Procedures of this type promote greater certainty in the outcome of the sensing/validation process and help to reduce the likelihood of a malfunction.

The validation arrangement preferably is based on the presence of at least two parameters in a defined relationship to one another. Parameters which are produced by the same shock tube event may be regarded as being independent of each other. However the parameters would have a relationship, to each other, which could only have resulted from a genuine shock tube event. One parameter may, for example, be light and a second parameter may be temperature. The characteristic of the light may be its amplitude and the characteristic of the temperature may be its rate of change. Additionally the characteristics must be present, i.e., detected, within a predetermined time period of one another.

Nonetheless it is possible to validate multiple characteristics of one parameter. For example, a detected light signal could be subjected to validation processes in respect of its amplitude, frequency and duration.

The module may include a switching arrangement which is responsive to a timing signal produced by the timer at an end of a timing interval.

When use is made of a plurality of sensors the switching arrangement may be dependent on respective output signals being generated or initiated by the sensors substantially simultaneously or having a defined time, amplitude or other relationship to one another.

The validation arrangement may include a memory in which data is stored as reference data which is representative of at least one characteristic of the at least one parameter which, with a shock tube event, is expected to be generated.

The memory may be any suitable memory, e.g., a non-volatile memory, and may be loaded with reference data under factory conditions so that it is not user-variable.

The validation arrangement may include a comparator for comparing information produced by the discriminating arrangement to the reference data. This allows a validation process to be carried out to ensure that output signals are only produced in response to validated characteristics of one or more parameters from a shock tube event, and not spuriously.

If the reference data is stored in a non-volatile memory then it is possible, according to requirement, to change the reference data, say during a manufacturing or testing phase, to take account of different operating conditions or shock tube types. This allows the potential use of the timer to be controlled. If the validation process is, effectively, carried out by means of a custom-designed circuit, also referred to as a hard-coded validation process, then the validation procedure is substantially inflexible. A software-based validation procedure can be made to be inherently more flexible in that the validation exercise can be carried out in terms of values which are loaded into a program for a defined application. In general terms it can be said that a hard-coded validation arrangement would be operable more speedily than a software-based system. Although speed could be advantageous it is possible to design a system which makes use of a relatively slower validation technique without jeopardising or compromising on blasting effectiveness.

The reference data may be stored in analogue form (e.g., a capacitively-stored charge) or digital form. Typically if the reference data is in analogue form a signal based on a chosen characteristic of a parameter must exceed a threshold. In the latter case (reference data stored in digital form) digital control is exercised over the validation exercise and numerical or equivalent comparisons may be effected. The invention is not limited in this way. Validation may be carried out by firmware or by means of a custom-designed circuit or hard-wired logic which, inherently, embodies selected characteristics which are based on representative data which are associated with a predetermined shock tube event.

At least the discriminating arrangement may be implemented using analogue or digital techniques or any combination thereof.

The timer may be operable immediately in response to detection of at least one parameter or to production of the first output signal, or in response to a plurality of output signals, or after a predetermined time period has passed after detection of at least one parameter or after production of at least the first output signal, or in response to any other factor which is uniquely associated with a genuine shock tube event.

Signals which are representative of the parameters may be monitored, in order to sense the characteristics thereof, during a qualifying window which may have a defined time spread and a defined amplitude spread.

If appropriate, use may be made of more than one qualifying time window and, within each window, one or more parameter signals may be monitored. A window may also be monitored to sense the absence of a parameter signal.

The monitoring of the absence of a parameter signal may be beneficial. For example, if light is a parameter then the presence of light at two spaced locations on a shock tube could be simulated by means of a high intensity light source which is aimed at the locations. This could lead to an incorrect determination of a shock tube event. If the absence of light is to be monitored then the use of a high intensity light source could not readily be used to simulate a shock tube event for if light is sensed at one location a spaced location should not be illuminated, and vice versa. This principle can be used repeatedly, for example, by monitoring various locations which are spaced apart for the presence or absence of light. With this kind of configuration, at any time, light would be detected only at one location and the time interval between detecting light at a first location and at a second location would be of a defined duration.

The timing module may include a first energy source and an initiating element which forms part of a detonator. The switching arrangement may be used to connect the first energy source directly or indirectly to the initiating element.

The initiating element may be any suitable device which is known in the art and the invention is not limited in this respect.

The first energy source may include a battery or at least one capacitor.

Energy derived from a second or primary energy source may be stored in the first energy source. The second energy source may be a battery.

The module may include a power management circuit which is used to transfer electrical energy from the second energy source into the first energy source. This may be in response to operation of the switching arrangement. The power management circuit may be designed to store electrical energy in the first energy source at a voltage which is higher than a voltage which is available from the second energy source.

In one form of the invention the transfer of electrical energy from the second energy source into the first energy source is commenced upon sensing a parameter or upon production of, at least, the first output signal, and is completed before the switching arrangement operates in response to, at least, the first output signal.

The timing module can be incorporated into a detonator, or principles selected from the aforegoing concepts can be embodied, as required, in a detonator.

BRIEF DESCRIPTION OF THE DRAWINGS

The invention is further described by way of example with reference to the accompanying drawings in which.

DESCRIPTION OF PREFERRED EMBODIMENTS

The propagation of a signal by a shock tube, whether by means of a combustion, deflagration, detonation or similar process (referred to herein as a "shock tube event"), produces a number of distinct physical effects (herein "parameters") such as the emission of light, the generation of a pressure wave, and the release of heat. The nature of these parameters, their relative amplitudes, and their interrelationship over time, are determined by the physical composition of the shock tube. It is practically impossible to simulate the specific characters and relationships of the parameters which occur in a shock tube event. The invention is based on the realisation that the unique characteristics of the various parameters which are generated by a shock tube event can be used, subject to carefully controlled validation processes, to control the operation of a timer module, and hence of an electronic detonator, in an effective and safe manner.

Figure 1:
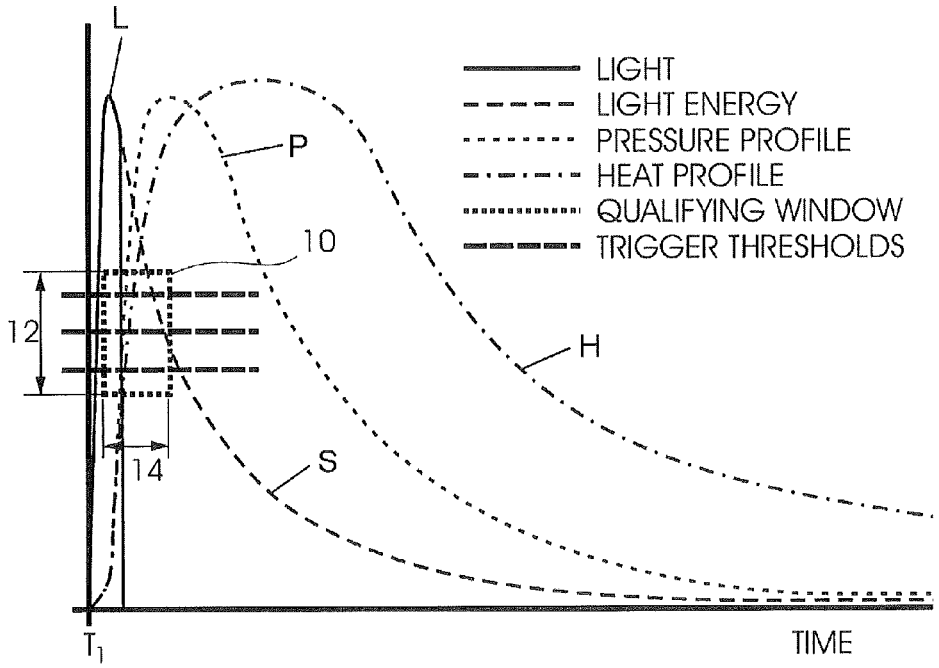
FIG. 1 shows how some parameters which are produced by a shock tube event vary over time.

FIG. 1 of the accompanying drawings has four normalised curves, labelled L, S, P and H, respectively, which illustrate how four parameters, which are generated by a shock tube event, vary as a function of time. These are, respectively, a light amplitude profile, a light energy profile, a pressure profile and a heat profile. These parameters are delivered in a very short time and some of the parameters occur substantially concurrently. The light energy curve S is notional only. If the amplitude of the light energy is determined at a given time (instant) then the curve would have the same shape as the curve L. If the energy in a light pulse is to be measured over a time interval, then the light amplitude would be integrated over the time interval. The shape of the curve S would then differ from what is shown. As the duration of a light pulse is short there may be benefits in measuring the light energy in a pulse, as opposed to the amplitude only, so that the pulse could be categorised, with a greater level of certainty, as having been produced by a shock tube event.

The amplitude of a light pulse rises from zero to maximum intensity, and then decays rapidly. A temperature rise associated with an advancing ignition front in a shock tube would generally lag the emission of light. The rise time of the temperature pulse would be slower and typically have a profile closer to that of the P and H curves. One possible validation procedure could then be based on the following:

a) detecting the presence of light at least of a predetermined magnitude;
b) detecting the absence of light within a window of defined duration commencing a defined period after successful completion of step (a); and
c) during or after the defined period in step (b), monitoring the rate of change of temperature.

The light amplitude and the rate of temperature change are validated by comparison processes. It is to be noted that, inherently, a further validation is carried out by use of a time window in that measurement of the rate of temperature change would only be effected and taken into account if there is an absence of light during the defined time window.

FIG. 1 illustrates a qualifying window 10 which has an amplitude spread 12 and a time spread 14. The window commences at time T1 after the onset of a shock tube event (time=0) which is taken as the time at which the shock tube event is presented to a timing module (as described hereinafter). Selected parameters which fall within the window are tracked and data pertaining to characteristics of each parameter are stored in a suitable form, analogue or digital, for subsequent retrieval, when required, as reference data. From tests done with representative shock tubes it is possible to record how the chosen parameters and the selected characteristics thereof vary, with respect to time, and the relationships between these characteristics, e.g., on a time, amplitude (magnitude), rate of change or other basis. These data are uniquely associated with a shock tube event. The specific natures and relationships of characteristics of parameters such as light, pressure, force, temperature and heat which occur in a shock tube event cannot readily be simulated. Moreover, if required, it is possible to incorporate in the material within a shock tube at least one or more particular elements or compositions ("additives"), which are specifically selected for the purpose, which give rise to one or more additional unique and distinctive characteristics, which may occur within the qualifying window 10 or at some other time. This capability offers substantial benefits from a security viewpoint for it enables the use of the shock tube to be restricted to a timing module, and an associated detonator, with complementary features, and vice versa.

In one respect, the characteristics which are to be monitored can be placed into two categories. A first category of characteristics includes those characteristics which are determined substantially instantaneously, for example, an absolute magnitude, the presence or absence of a signal, or the rate of change of a characteristic, at a given time. A second category of characteristics includes those which are time-dependent, for example, the duration of a signal, the time taken for a signal to appear and then to be absent, and a value which is given by an integral of a time-dependent signal. With the former characteristics, validation procedures can be carried out more rapidly than for characteristics which fall in the second category.

The selected characteristics are categorized as input stimuli which can be electronically detected and processed. The number of stimuli which can be detected could be increased to achieve a commensurate increase in the level of certainty that a genuine shock tube event has been identified. This aspect of the invention is based on the principle that a shock tube event can be positively and accurately identified by characteristics which are uniquely associated with selected parameters produced when a shock tube event is presented at a defined location, and which lend themselves to validation procedures. Incoming data from a tentative shock tube event is subjected to validation processes which are carried out with an exceptional degree of reliability. Upon validation a process of timing a defined time interval is completed. Use is made of electronic means to control the duration of the timing interval for in this way a desired degree of accuracy is achieved.

Figure 2:
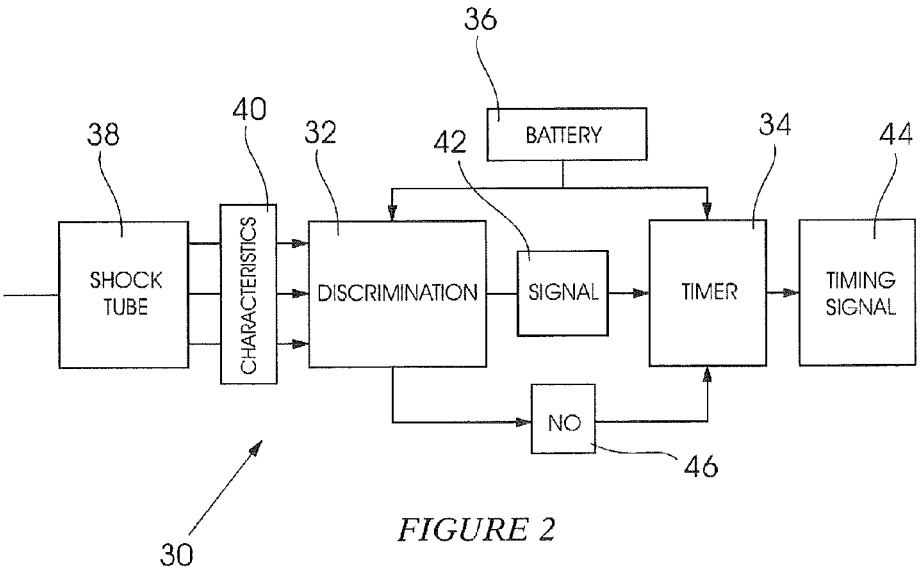
FIG. 2 is a block diagram representation of a timing module according to the invention.

FIG. 2 is a block diagram representation of certain aspects of a circuit of a timing module 30 according to one form of the invention. The timing module includes a discriminating arrangement 32 which controls the operation of an electrical timer 34. A battery 36 powers the arrangement 32 and the timer 34.

An end of a shock tube 38 is presented to the discriminating arrangement 32. This can be done in any appropriate way. Conveniently the end, not shown, is connected via a suitable coupling to a housing which contains the timing module 30. Use could be made of a single coupling which allows for the detection of parameters which are presented at the end of the shock tube. This is exemplary only and non-limiting. In an alternative arrangement, two or more connections are made to a shock tube, preferably near an end of the tube. These connections are spaced apart in an elongate direction of the shock tube. At each connection the shock tube is monitored, using suitable sensors, for the presence or absence of predetermined parameter characteristics. The spacing between the connections lends itself, inherently, to monitoring another characteristic, namely, the speed of propagation of a wave front (ignition front) in the shock tube. For example, at one connection point the magnitude of a light pulse, the rate of change of temperature and the time interval between a maximum light pulse amplitude and a maximum temperature can be detected and measured. These measurements can then be subjected to validation processes. Alternatively, or additionally, the same parameter characteristics are detected and measured at a second connection point which is a known distance from the first connection point. The two sets of parameter characteristics should be identical, except for a time shift which is of known duration. The validation processes are then completed by comparing one set of parameter characteristics to the second set of parameter characteristics. This exercise, which can be carried out in a single validation process or in an additional validation process, enables the speed, and the direction, of propagation of a shock tube event in a shock tube to be verified.

The discriminating arrangement 32 includes a number of sensors (described hereinafter) which monitor parameters of a shock tube event to sense characteristics 40 thereof. If one characteristic is detected and positively identified or validated a signal 42 is produced. The timer is caused to start a timing cycle upon detection of the characteristic.

During the execution of the timing cycle further characteristics presented by parameters of the shock tube event to the discriminating arrangement are detected and validated. If all the inputs to the discriminating arrangement are validated then the timer is allowed to complete its timing cycle and at the end thereof a timing output signal 44 is generated.

In the preceding example the timing cycle is started upon detection of the light signal. The amplitude of the light signal, and the rate of temperature change, are then validated. Alternatively the commencement of the timing cycle takes place only if these two characteristics are validated. In each instance the timing cycle is only completed if, at the second connection, substantially identical signals for the light amplitude and the rate of temperature change are measured.

If the characteristics are not validated, or if validation does not take place within a period which is less than the duration of the timing interval or cycle, a signal 46 is sent to the timer to stop its operation. The timing output signal 44 is then not generated, and execution of the timing interval is terminated. Hence the timer is only permitted to continue with the execution of the timing cycle if the signal 42 is produced. If the signal is not produced, i.e., if no validation takes place within a predetermined time interval, the execution of the complete timing cycle is stopped. In another implementation the timer commences execution of the timing cycle only when the signal 42 is produced.

In one particularly preferred embodiment a single sensor, such as a photodiode, is used to monitor two parameters of one shock tube event. For example, light, preferably light amplitude, and temperature (the magnitude of the temperature) may be monitored by the use of the photodiode which is biased through the use of an appropriate circuit in a first way so that it is responsive to a light signal and thereafter is biased in a second way so that it is responsive to temperature.

The timing output signal can be used, in a surface harness in a blasting system, to propagate a delay along the harness. Alternatively, as is further described herein, the timing output signal is used to control the firing of an initiating element in a detonator which has been placed in a borehole.

Figure 3:
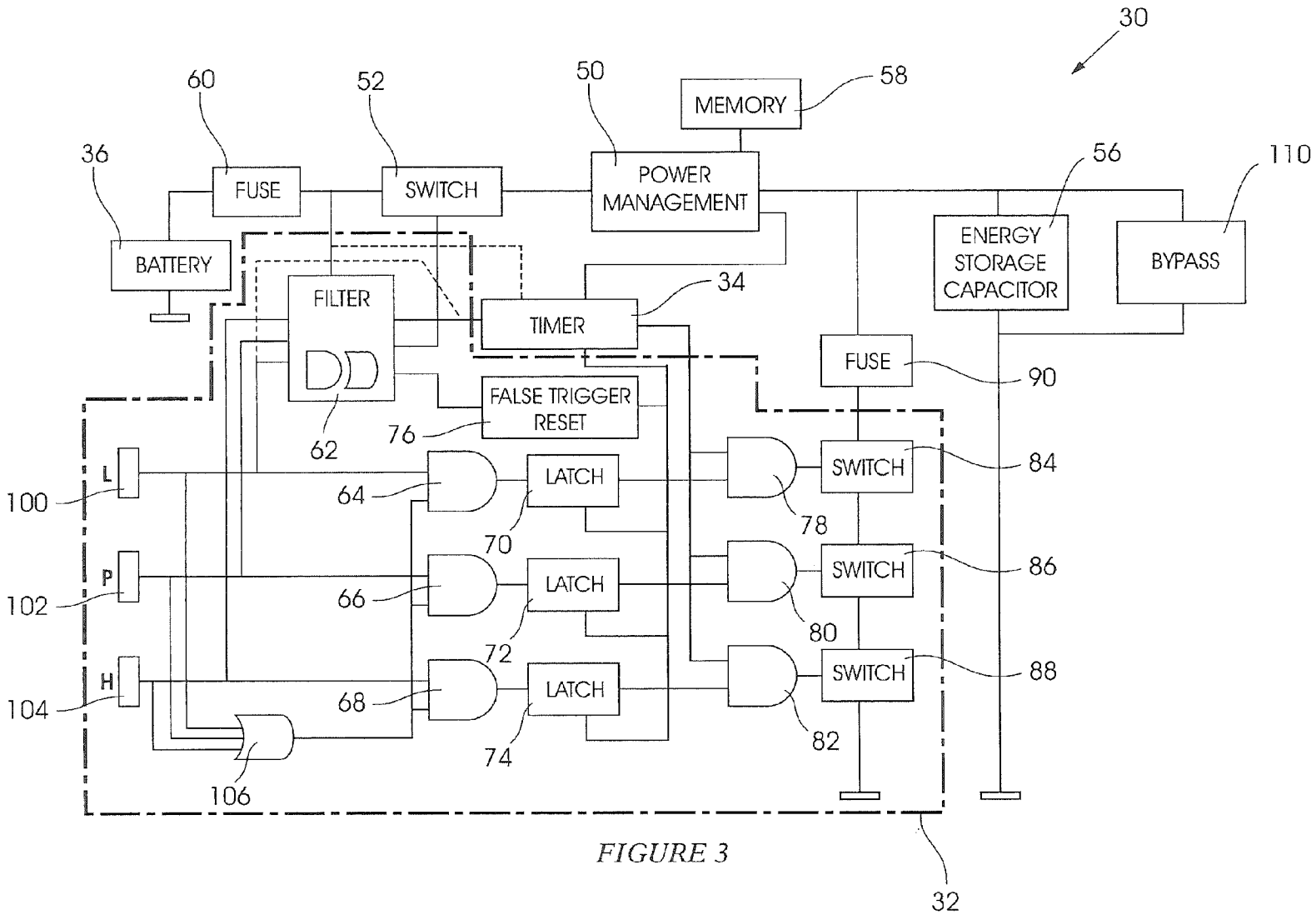
FIG. 3 illustrates in more detail some aspects of the block diagram shown in FIG. 2, when the timing module is used for generating a time delay prior to firing an initiating element in a detonator.

FIG. 3 illustrates additional aspects of the timing module. The discriminating arrangement 32 is enclosed in a dotted line. Connected to the discriminating arrangement is a processor 50 which includes a power management circuit and, optionally, a communication unit (as is hereinafter described), a switching arrangement 52, an energy storage capacitor 56 and a memory 58. The battery 36 is connected to the discriminating arrangement 32 via a fuse 60. The discriminating arrangement 32 includes a digital filter 62, three AND gates 64, 66 and 68, respectively, latching circuits 70, 72 and 74, a trigger reset unit 76, AND gates 78, 80 and 82, switches 84, 86 and 88, respectively, which are connected to outputs of the AND gates 78 to 82, and an initiating device 90 which is of any appropriate kind and which is connected in series with the switches 84 to 88.

Three sensors 100 to 104 are respectively connected to the AND gates 64 to 68 and have inputs connected to an OR gate 106. Inputs also go to the filter 62.

Appropriate data are stored in the memory 58 which is connected to the power management circuit 50. These data, typically, include identity data pertaining to, or otherwise associated with, a detonator with which the timing module 30 is to be used, such as timing data, detonator trigger parameters, detonator manufacturing and tracking information, a detonator identifier which is uniquely associated with the detonator, and the like. This list is exemplary only and is non-limiting.

The timing module 30 also includes a communication unit which may be embodied in the processor 50. The communication unit allows communication to take place between control apparatus such as a blast controller (not shown) and the remainder of the power management circuit, the programmable timer and the memory. This feature is of value for, via the communication unit, the data in the memory 58 can be varied to suit operational conditions. For example, the timer could be programmed to change the duration of a timing interval which is executed upon successful validation of parameter characteristics, in accordance with program requirements. The use of a detonator can also be rigidly managed, for firing of the detonator could be inhibited in the absence of defined input criteria.

It is possible to have different validation processes which are carried out in respect of a shock tube event. Each validation process is structured to be as reliable and accurate as any other validation process. Merely by way of example one validation process could be in respect of light amplitude and rate of temperature change while another validation process could be based on the duration of a light pulse and the time interval between a maximum amplitude of a light pulse and a maximum temperature. The communication unit could be employed to ensure that a chosen validation process is implemented. In a blasting arrangement based on the use of a plurality of detonators, data pertaining to each validation exercise could be transferred to the memory of each detonator under field conditions using the respective communication units. Prior to this exercise, which is similar to a preliminary arming process, it would not be possible, irrespective of the validation process which is carried out, for a detonator to be fired.

Similarly, data from each detonator, e.g., data relating to a detonator status, could be transferred by the respective communication unit to a blast programmer, or to a blast controller.

A primary function of the filter 62 is to derive data from incoming characteristics of selected parameters for validation or confirmation purposes, or directly to validate this data. The filter specifications can be configured or determined in respect of any suitable characteristics which uniquely identify a shock tube event, such as a threshold level or rise time of a parameter, the rate of change of a parameter with time, the integrated value of a parameter over a particular time interval, and the presence and duration, or absence, of one or more parameters within a qualifying timing window or within a plurality of qualifying timing windows. In one implementation, characteristics relating to parameters arising from a shock tube event are processed for validation purposes during a first qualifying window and characteristics from the same or different parameters, as desired, are processed for validation during a second qualifying window or a plurality of subsequent qualifying timing windows.

The filter 62 controls the operation of the switching arrangement 52 and of the timer 34. The timer is programmable to execute a chosen time delay period, as is known in the art. At the end of the time delay period the initiating element 90 is ignited in order to fire a detonator, not shown.

The components which are included in the timing module have a low current consumption. This allows the battery in the power supply arrangement to remain connected permanently, at least to the discriminating arrangement. Preferably the battery is connected, additionally, to applicable parts of the remainder of the circuit, for example, to the validation arrangement. Depending on the construction of the timer the battery may be connected permanently to the timer and the timer may then be started by application of an appropriate control signal. Alternatively, the timer is started by connecting the battery to the timer. The permanent battery connection is feasible, from a safety point of view, because the initiating element 90 can only be ignited by a firing signal which is generated with a high level of certainty under strictly controlled conditions. This factor facilitates, in one respect, manufacture of the timing module for the need for a switching circuit which can connect the battery to the remainder of the circuit, under defined conditions, is eliminated.

The module 30 is coupled to the shock tube 38 in such a way that the sensors 100 to 104 are exposed at least to selected physical processes which result upon signal propagation by the shock tube. Thus the sensor 100 is responsive to light intensity (amplitude) or frequency or, optionally, to both values. The sensor 102 responds to a pressure level, i.e., the absolute or relative value of pressure. The sensor 104 is heat-sensitive and is directly responsive to the temperature level or to the quantum of heat which is incident on the sensor. These responses are given by way of examples only and are non-limiting.

It is apparent from the aforegoing that the filter may be used to validate at least some characteristics, directly. Alternatively, or additionally, a signal from the filter may be subjected to validation by comparing the signal to reference data pertaining to the respective characteristics, stored, for example, in the memory which could be non-volatile memory.

If any of the sensors produces a positive signal, then this is indicative that a preselected characteristic has been detected. The switching arrangement 52 is initiated and the timer 34 is started. Alternatively, these events take place only upon validation of a respective signal from the, or each, sensor. This allows the timer to start its timing interval as close as possible to the onset of the shock tube event. It is possible, though, to allow for an offset time period so that the timer is caused to start a timing interval only after a predetermined delay from the onset of the shock tube event. The use of an offset time period holds benefits in that management and operational functions can be carried out by the management circuit and, only if those functions are satisfactorily completed, is the timing interval thereafter started.

If the timer is wrongly started or if a validation process is unsuccessful or is not correctly implemented then, in response to a subsequent signal 46 output by the filter, the trigger reset unit 76 is actuated so that the timer can be reset.

Assume that the timer 34 commences a timing interval upon detection of a first positive signal from the filter, produced by the sensor 100. If a signal from either of the sensors 102 and 104 is not confirmed as being representative of a characteristic of a shock tube event then the timing process is immediately terminated. If all the signals output by the sensors are verified by the filter then the timer 34 is allowed to execute its full timing period and the latching circuits 70 to 74 are actuated. The switching arrangement 52 is operated at a suitable time, and energy from the battery 36 is transferred by the power management circuit 50 to the capacitor 56 which is thereby charged to a suitable voltage. Preferably, the battery 36 is not capable of igniting the initiating element at least within a different time interval of predetermined duration, for example, because the battery voltage is too low or the battery cannot output adequate power.

The charging of the capacitor can take place while the timer 34 is counting its timing period. At the end of that period an output signal from the timer is applied to the AND gates 78 to 82 and the switches 84 to 88 are simultaneously closed. Energy from the capacitor is then discharged through the initiating element 90 which is thereby ignited.

Thus, in combination, the battery 32, the capacitor 56 and the power management circuit 50 make up a power supply arrangement to power operation of the circuits in the detonator and to produce energy at an appropriate level for firing the element 90.

If a fault occurs which prevents ignition of the element 90, for example, if simultaneous closure of the switches 84 to 88 does not take place, a bypass circuit 110 is operated by the processor/power management circuit 50 so that the energy, which had previously been stored in the capacitor, is discharged within the aforementioned defined time interval. This energy is thereby safely dissipated and is not available to ignite the initiating element. This is a beneficial feature which allows the effect of a detonator misfire to be effectively and reliably negated. Alternatively, or additionally, the bypass circuit 110 can be used to discharge the battery fully. Also, the processor/power management circuit can be used to control the functioning of the switching arrangement 52 so that the battery is connected to the fuse 60 in a manner which causes the fuse to melt or blow. The battery is then isolated from the remainder of the circuit.

The sensing and validation functions carried out by the discriminating arrangement 32 can be effected by means of a single circuit (preferably an integrated circuit) constructed for the purpose, or by means of two or more circuits, according to requirement. For example, a first circuit could be used to sense and process characteristics of parameters such as light and pressure and a second circuit could be used to sense and process characteristics of parameters such as heat and sound.

In another approach substantially identical circuits are operated in parallel. Each circuit senses and executes validation processes on the same set of characteristics. Through the use of appropriate logic circuitry the initiating element 90 is only ignited if the circuits produce substantially identical outputs. Redundancy arrangements of this kind enhance the inherent reliability and safety of the timing module.

What is claimed is:

1. A timing module, for use in a blasting system, which includes at least a first discriminating arrangement with at least one sensor which senses at least one characteristic of at least one parameter generated by at least one shock tube event, a validation arrangement which produces at least a first output signal if the at least one sensed characteristic is validated, and a timer which completes execution of a timing interval of a predetermined duration only if, at least, the first output signal is produced.

2. A timing module according to claim 1 wherein the at least one parameter is selected from an electromagnetic signal, an acoustic signal, a pressure signal, a force, heat emission and temperature.

3. A timing module according to claim 1 or 2 wherein the characteristic is selected from a frequency, amplitude, rate of change and an integral with respect to time, of the parameter.

4. A timing module according to claim 1 wherein the first discriminating arrangement includes a plurality of sensors and each sensor is used to sense at least one characteristic of a respective parameter.

5. A timing module according to claim 1 wherein the first discriminating arrangement includes at least one sensor which is used to sense one or more characteristics on a basis integrated with respect to time or differentiated with respect to time.

6. A timing module according to claim 4 wherein the timer is operable to complete execution of the timing interval only if each sensed characteristic is validated and if the sensed characteristics are present in a defined relationship to one another.

7. A timing module according to claim 1 wherein the validation arrangement includes a memory in which data is stored as reference data which is representative of at least one characteristic of the at least one parameter, and a comparator arrangement for comparing information produced by the at least one sensor to the reference data.

8. A timing module according to claim 1 wherein the at least one sensor is used to sense at least one characteristic during a qualifying window which has a defined time spread and a defined amplitude spread.

9. A timing module according to claim 1 wherein the at least one sensor is used to sense the absence of a characteristic during at least one qualifying time window.

10. A timing module according to claim 1 which includes a first sensor to sense light amplitude and a second sensor to sense amplitude or rate of change of temperature.

11. A timing module according to claim 1 which includes a single sensor which senses a first parameter and a second parameter.

12. A timing module according to claim 11 wherein the first parameter is light and the second parameter is temperature.

13. A timing module according to claim 1 wherein execution of the timing interval is commenced in response to sensing of the at least one characteristic.

14. A timing module according to claim 1 wherein execution of the timing interval is commenced in response to production of the first output signal.

15. A timing module according to claim 1 which includes a second discriminating arrangement and wherein the first and second discriminating arrangements sense parameter characteristics at respective locations on the shock tube which are displaced from each other.

16. A timing module according to claim 15 wherein the first and second discriminating arrangements are responsive at least to one of the following: the speed of propagation of a shock tube event in the shock tube; the direction of propagation of a shock tube event in the shock tube.

17. A timing module according to claim 1 which includes a memory in which data, selected from the following, are stored: timing data, detonator trigger parameters, detonator manufacturing and tracking information, detonator identification data.

18. A timing module according to claim 1 wherein the timer is programmable.

19. A timing module according to claim 1 which includes a communication unit which can communicate with an external controller.

20. A timing module according to claim 17 which includes a communication unit which can transfer data, from the memory, to an external controller.

21. A timing module according to claim 1 wherein execution of the timing interval is commenced only after a predetermined time delay period from sensing of the at least one characteristic, or from production of the first output signal.

22. A timing module according to claim 1 which includes a first energy source, an initiating element which forms part of a detonator, and a switching arrangement which, in response to a timing signal produced at an end of the timing interval, is operable to connect the first energy source to the initiating element thereby to cause firing of the initiating element.

23. A timing module according to claim 22 which includes a second energy source and a power management circuit which transfers electrical energy, derived from the second energy source, into the first energy source at a voltage which is higher than a voltage which is available from the second energy source.

24. A timing module according to claim 23 wherein the transfer of electrical energy into the first energy source is completed before the switching arrangement connects the first energy source to the initiating element.

25. A timing module according to claim 1 wherein at least one parameter, which gives rise to at least one unique characteristic, is generated by a shock tube event which results from the incorporation into the shock tube of at least one additive which is chosen for the purpose.

26. A timing module according to claim 1 wherein the timer completes execution of the timing interval only if, during the timing interval, at least a second output signal is produced by the validation arrangement.

27. A timing module according to claim 1 wherein the validation arrangement includes a filter which is configured to validate at least one of the following characteristics: a threshold level or rise time of a parameter; a rate of change of a parameter with time; an integrated value of a parameter over a particular time interval; a presence, or an absence, of one or more parameters within at least one qualifying time window.

28. A timing module according to claim 1 wherein the at least one sensor senses at least a first characteristic of a first parameter during a first qualifying time window and at least the presence or absence of a second characteristic of the first parameter or of a second parameter during at least a second qualifying time window.

29. A timing module according to claim 22 wherein the switching arrangement includes first and second switches which are connected in series with each other, with the initiating element and the first energy source.

30. A timing module according to claim 1 wherein the validation arrangement produces the first output signal if a first sensed characteristic is validated and a second output signal if a second sensed characteristic is validated, and wherein the timer completes execution of the timing interval only if the first output signal and the second output signal are produced.

31. A timing module according to claim 22 which includes a circuit which discharges energy from the first energy source if the timing signal is not produced at the end of the timing interval.

32. A timing module according to claim 22 which includes a circuit which discharges energy from the second energy source if the timing signal is not produced at the end of the timing interval.

33. A timing module according to claim 32 wherein the circuit also discharges energy from the first energy source at the end of the timing interval.

34. A timing module according to claim 1 wherein the timer commences execution of the timing interval:

i. immediately in response to sensing of the characteristic or production at least of the first output signal; or ii. after a predetermined time period has passed after sensing of the characteristic or production of at least the first output signal.

35. A timing module according to claim 1 which includes a battery which is permanently connected to the first discriminating arrangement and to the validation arrangement and which is connected to the timer, to allow execution of the timing interval, only if the at least one characteristic is sensed or if the first output signal is produced.

36. A timing module for use in a blasting system which includes a sensing arrangement which senses at least one characteristic of at least one parameter generated by at least one shock tube event, a memory in which data is stored as reference data which is representative of at least one characteristic of the at least one parameter, a comparator arrangement for comparing information produced by the at least one sensor to the reference data, thereby to validate the information, and a timer which is operable to complete execution of a timing interval of a predetermined duration if the information is validated.

37. A timing module which includes a sensing arrangement which senses at least one unique characteristic, generated by a shock tube event, which results from the incorporation into the shock tube of a selected additive, and a timer which completes execution of a timing interval of a predetermined duration, only if the unique characteristic is sensed.

38. A detonator which includes a timing module according to claim 1 and an initiating element which is fired in response, at least, to the first output signal.

* * * * *